United States Patent [19]

Schulz et al.

[11] 3,952,497

[45] Apr. 27, 1976

[54] METHOD AND APPARATUS FOR SYNCHRONIZING ANDOSCILLATING SYSTEM WHICH IS DRIVEN BY AN ENERGY STORAGE DEVICE

[75] Inventors: Hansrichard Schulz, VS-Villingen; Herbert Hummel, Niedereschach, both of Germany

[73] Assignee: Heinz Jauch, VS-Schwenningen, Germany

[22] Filed: Oct. 23, 1974

[21] Appl. No.: 517,430

[30] Foreign Application Priority Data

Oct. 24, 1973 Germany ..... 2353200

[52] U.S. Cl. ..... 58/28 R; 58/107; 58/23 R

[51] Int. Cl.[2] ..... G04C 3/04

[58] Field of Search ..... 58/23 R, 23 D, 23 A, 58/23 BA, 85.5, 33, 34, 28 R, 28 A, 28 B, 28 D, 109, 107; 73/6

[56] References Cited

UNITED STATES PATENTS

| | | | |
|---|---|---|---|
| 3,451,210 | 6/1969 | Helterline et al. | 58/23 R |
| 3,568,430 | 3/1971 | Walton | 58/23 R |
| 3,597,634 | 8/1971 | Flaig | 58/23 A X |
| 3,613,351 | 10/1971 | Walton | 58/23 BA |
| 3,629,727 | 12/1971 | Berney | 58/23 A X |
| 3,787,715 | 1/1974 | Eaton | 58/23 R X |
| 3,789,599 | 2/1974 | Dome | 58/23 R |
| 3,807,164 | 4/1974 | Zaisky et al. | 58/28 R |
| 3,812,670 | 5/1974 | Nikaido et al. | 58/23 D X |
| 3,818,376 | 6/1974 | Keller et al. | 58/23 A X |

*Primary Examiner*—L. T. Hix
*Assistant Examiner*—U. Weldon
*Attorney, Agent, or Firm*—Haseltine, Lake & Waters

[57] ABSTRACT

A technique of synchronizing an oscillating system driven by a mechanical energy storage means, particularly a timepiece having a regulating member which is set and maintained in oscillation by a pulse-like driving moment and which is synchronized by electromechanical action by means of timing pulses derived by division from a quartz oscillation, characterised in that the synchronizing action is achieved through an electromagnetic coupling or electromotively through indirect synchronization, in which a phase and frequency comparison is made between said timing pulses and an alternating voltage signal derived from the movement of the oscillating system, for example of the balance, with the oscillating system of corresponding frequency and phase, while in addition a regulating signal is derived from the comparison and is utilized to produce a torque $M_R$ which through the electromagnetic coupling applies a regulating action to the oscillating system.

30 Claims, 10 Drawing Figures

1
2
13
14
15
16
5
4
7
+ 1,5 V
0V
8
9
Mechanical Drive System
200

1
2
13
14
15
16
5
4
7
10
11
12
+1,5V
0V
8
200
Mechanical Drive System 1
2
13
4
7
200
Mechanical Drive System
10
11
12
+0,75 V
31
8
0V
32
30
29
-0,75

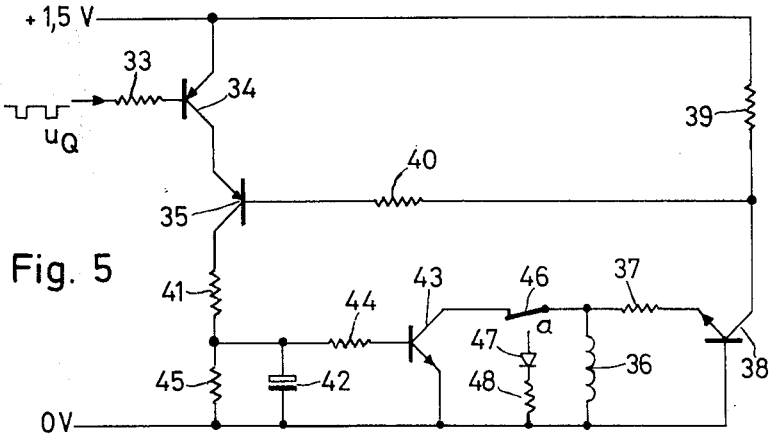
Fig. 5
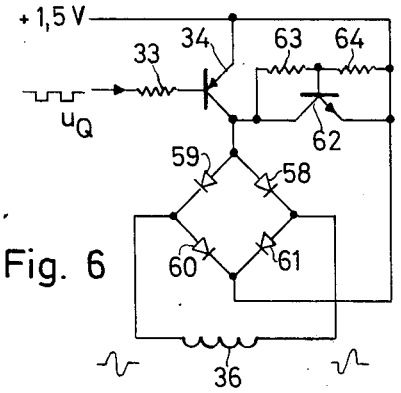
Fig. 6
Fig. 7
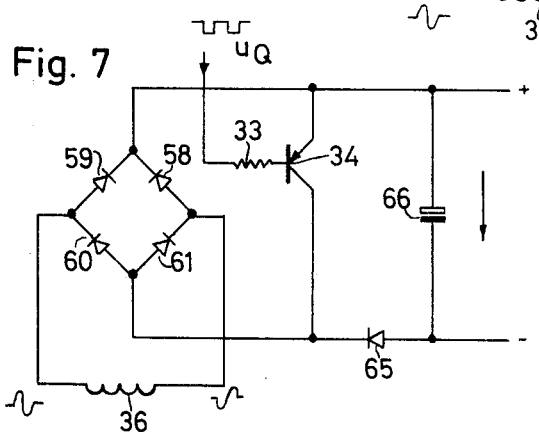

METHOD AND APPARATUS FOR SYNCHRONIZING ANDOSCILLATING SYSTEM WHICH IS DRIVEN BY AN ENERGY STORAGE DEVICE

FIELD OF THE INVENTION

The invention relates to methods and apparatus for the synchronizing of oscillating systems of the type driven by energy storage devices, and more particularly to methods and apparatus for synchronizing timepieces having regulating members which are set and maintained in oscillation by pulse-like driving moments and which are snchronized by electromechanical action by means of timing pulses derived by division of oscillations generated by quartz oscillators.

BACKGROUND OF THE INVENTION

In known mechanically driven timepieces, the mechanical storage of energy is effected by means of weights or driving springs. Furthermore, mechanical components in the oscillating system determine frequency and effect regulation of running. Purely mechanical timepieces of this kind are relatively simple, inexpensive and of robust construction.

In the course of progress of technology, purely electronic quartz timepieces have been developed in which timing pulses are derived directly from the divided quartz oscillation. In addition, transistorized balance timepieces are known in which direct synchronization of the transistor-driven rotary pendulum is effected by means of the quartz timing pulse. Both these timepiece movements have good accuracy of running, but are relatively elaborate and expensive. Further, they require larger electrical energy storage means for driving the associated timepieces.

Finally, mixed systems including mechanically driven timepieces are known in which pulses of a subdivided reference frequency are transmitted to an electromechanical transducer which acts on a mechanical synchronization device. This direct synchronization with direct action of the pulses on the timepiece has the disadvantage that the attainable range of synchronization is too small for many purposes.

SUMMARY OF THE INVENTION

An object of the invention is to provide a method and an apparatus of the kind indicated, by means of which the range of synchronization of a quartz-synchronized timepiece can be substantially enlarged in a relatively simple and extremely effective manner and in which the accuracy of running is very good.

According to the invention, the above and other objects are attained by a method which is characterized in that synchronizing action is achieved through an electromagnetic coupling by indirect synchronization in which a phase and frequency comparison is made between timing pulses and an alternating voltage signal derived from the movement of the oscillating system (for example, of the balance) with an oscillating system of corresponding frequency and phase, a regulating signal being derived from this comparison and being utilized to produce a torque $M_R$ which through the electromagnetic coupling applies a regulating action to the oscillating system.

This indirect contactless synchronization with electronic phase comparison according to the invention results in a robust, substantially mechanical timepiece drive of relatively simple construction, with good accuracy of running and a wide synchronization range. With exact synchronization, the regulation achieved by means of the regulating signal can be effected in the middle of a regulating characteristic line, so that optimum compensation for frequency variation in both directions can be achieved. This symmetrical synchronization range is still broader so that, in the case of series production, no excessive demands need be made with respect to accuracy of running and, consequently, with respect to accuracy of adjustment and frequency stability of the freely oscillating mechanical oscillating system, such as may be necessary in the case of direct synchronization.

For the purpose of achieving optimum frequency control, it is at the same time particularly preferred that the synchronization be effected with an azimuthal displacement angle $\psi$ of the pulse-like regulating moment $M_R$ in relation to the passage through zero of the oscillating system, while the optimum displacement angle for achieving the greatest possible frequency control amounts to $$\psi\, opt = 0.71 \cdot \Phi$$

in which $\Phi$ is the amplitude of the oscillating system. This results from the considerations described below.

In the case of indirect synchronization, the loading or control of the oscillating system results in the application to the latter of a regulating or synchronizing pulse-like torque having a fundamental oscillation component $$c_{1R} = \sqrt{a_{1R}^2 + b_{1R}^2} \qquad 1.$$

which is dependent on the azimuthal displacement angle $\psi$ and on the amplitude of the oscillating system. At the same time, the Fourier coefficient of the cosine oscillation, $a_{1R}$, affects only the amplitude and the Fourier coefficient of the sine oscillation, $b_{1R}$, affects only the frequency of the oscillating system. The following applies to the relationship with the time phase displacement $\alpha_R$ of the regulating moment $M_R$:

$$\psi = \Phi \cdot \sin \alpha_R;\ \alpha_R = \arcsin \frac{\psi}{\Phi} \qquad 2.$$

As a first approximation, the regulating moment $M_R$ is proportional to the angular velocity, that is to say to the first time derivative of the instantaneous angle of the oscillating system, at a point displaced by the displacement angle. If the regulating moment $M_R$ in the coupling region is assumed to be constant and outside this region is assumed to be equal to zero, the Fourier coefficient $b_{1R}$ of the sine oscillation can be determined as follows:

$$b_{1R} = k \sin(2\alpha_R),\ \text{where } k = \frac{1}{\pi} \cdot M_R\,(\alpha_R{=}0) \cdot \sin(\pi\tau R/T \qquad 3.$$

$\tau_R$ here signifies the action or coupling time of the regulating moment $M_R$ in relation to the oscillating system. From this equation, it is possible to calculate the optimum phase displacement angle $\alpha_R$ for which $b_{1R}$ is a maximum. In conjunction with the conditional equation (2), the following is obtained:

$$\alpha_R \text{ opt.} = \frac{\pi}{4} \rightarrow \psi_{opt} = -0.71 \cdot \Phi \qquad 4.$$

This optimum azimuthal displacement angle provides the greatest possible frequency control and consequently the widest possible synchronization range.

Furthermore, provision is in addition made for the sine portion $b_{1R}$ of the fundamental oscillation component $c_{1R}$ of the regulating moment $M_R$ to be selected as follows:

$$b_{1R} \geqq -2 \cdot D \cdot \frac{f_o - f_o^*}{f_o}$$

where D is the direction moment, the amplitude, and the quotient the relative resonance frequency variation of the oscillating system as the result of the influence of the synchronization. When the Fourier coefficient is selected in this manner, the system which freely oscillates with $f_o$, and which would lag or move away in relation to the case of synchronization, is exactly synchronized by the torque or regulating moment $M_R$, as will be seen from the following considerations:

In the case of low values, the frequency variation brought about by indirect synchronization amounts to $$\Delta f = f_o - f_o^* \sim -\frac{1}{2} \cdot f_o \cdot \frac{b_{1R}}{\Phi} \qquad 5.$$

so that the frequency variation is linearly proportional to the Fourier coefficient $b_{1R}$. In order to maintain the synchronization at a determined frequency, that is to say when the freely oscillating system tends "to move away from" or "lag behind" the quartz timing, $b_{1R}$ and consequently the torque or regulating moment $M_R$ of the indirect synchronization would have to fulfil the following equation:

$$b_{1R} = -2 \frac{\Delta f}{f_o} \cdot D \cdot \Phi \qquad 6.$$

As indicated above, the Fourier coefficient $b_{1R}$ must be in linear proportion to the relative frequency variation and to the repelling moment $D \cdot \Phi$ of the system.

In order to perform the method of the invention, an apparatus is provided which comprises a quartz timing oscillator preceding a frequency divider to form quartz-accurate timing pulses, and a synchronization circuit or transducer acted on thereby, and which is distinguished by a phase comparison stage connected to the quartz timing pulse generator and to the transducer, by means of which stage the transducer coupled electromagnetically to the oscillating system is subjected to a synchronizing action corresponding to the relative phase position between the timing pulses and the movement pulses induced in the transducer.

Effective synchronization with accurate running and with a side synchronization range is in this way achieved by relatively simple means. Either a synchronizing phase-dependent loading of greater or lesser intensity is thereby effected in at least one of the half-oscillations of the system, or else two-point synchronization with phase comparison is effected, by which the oscillating system is accelerated or braked by other elements, preferably electromagnetically. The phase comparison is preferably effected by means of AND gates.

Instead of a battery for the voltage supply, it is possible to use a dynamo which is coupled to the oscillating system and the dynamo coil of which may also be combined with the transducer coil and be displaced by the displacement angle in relation to the passage through zero. In the optimum case, this angle should be selected within the limits:

$$0.26\Phi < \psi_{opt} < 0.71\Phi \qquad 7.$$

Within this range, both the damping and the frequency detuning components of the fundamental oscillation portion of the regulating moment are sufficiently great and at least equal to half the maximum values of the corresponding components.

BRIEF DESCRIPTION OF DRAWING

The invention is explained in greater detail below with reference to the accompanying drawings in which:

FIG. 5 is a schematic diagram of a synchronization circuit arrangement with a transistor-transistor-AND gate-phase discriminator;

FIG. 6 is a schematic diagram of a synchronization arrangement with a transistor-rectifier-AND gate -phase discriminator;

FIG. 7 is a schematic diagram of the synchronization circuit arrangement of FIG. 6 with and additional supply voltage source;

DETAILED DESCRIPTION OF THE DRAWING

Figure 1:
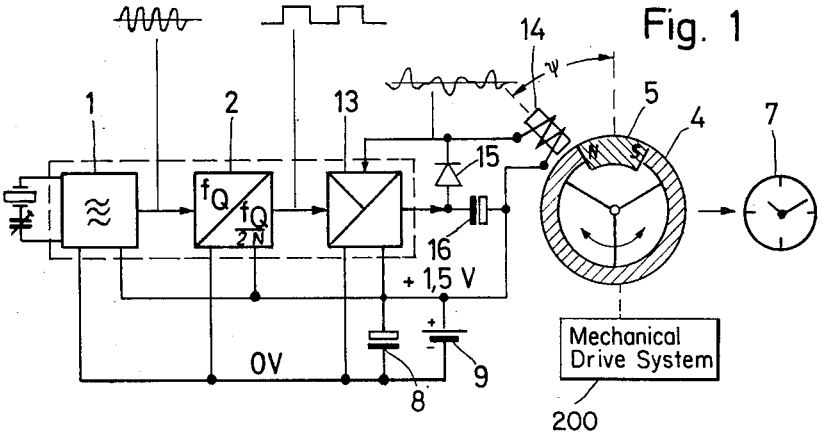
FIG. 1 shows diagrammatically an arrangement for effecting indirect synchronization utilizing a battery.

In the arrangement shown in FIG. 1 for indirect synchronization of a balance 4 having a permanent magnet 5 fastened in the zero passage position, use is made of a quartz oscillator 1 followed by a divider 2 whose quartz-accurate output timing pulses are fed to a phase discriminator 13. The balance 4 is driven by a conventional mechanical drive system 200 which contains a mechanical energy storage means.

A transducer coil 14 of an electromagnetic transducer 14, 15 is displaced by the displacement angle $\psi$ in relation to the passage through zero, and is part of a "regulating dynamo" 14, 15, 16. In the latter, a series connection consisting of a charging capacitor 16 and a diode 15 is connected as rectifier in parallel with the transducer coil 14.

The connection point between the charging capacitor 16 and the diode 15 is coupled to the output of the phase discriminator 13. The alternating voltage signal produced in the transducer coil 14 by the movement is in addition transmitted through a second input to the phase discriminator 13, which in turn effects a phase and frequency comparison of this signal with the timing pulses.

For the supply of voltage to the quartz oscillator 1, the divider 2, and the phase discriminator 13, use is made of a battery 9 blocked by means of a capacitor 8. The timepiece drive is connected in known manner to an analog or digital time indicator 7.

The indirect synchronization with electronic phase comparison can, for example, be effected by loading the "regulating dynamo" 14, 15, 16, in pulse form and in accordance with the phase position, to a greater or lesser extent on the average with the output of the phase discriminator 13 during each cycle, in order to brake the oscillating system to a greater or lesser extent and thus to synchronize it with quartz accuracy. This produces a retardation or acceleration when the regulating dynamo loads the balance in the range of increasing or decreasing angular velocity.

Figure 2:
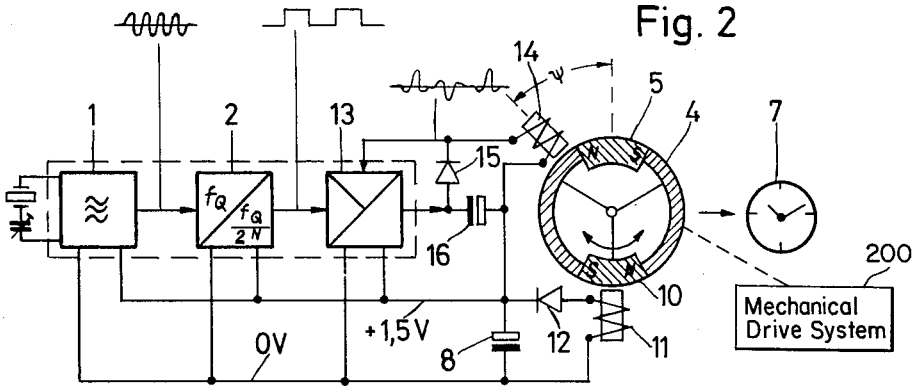
FIG. 2 diagrammatically shows an arrangement which corresponds substantially to that shown in FIG. 1 but in which the synchronization energy is derived from the moment energy of the oscillating system.

The arrangement shown in FIG. 2 corresponds substantially to that shown in FIG. 1, with the sole exception that a dynamo 10,11,12 is used to produce the operating voltage instead of a battery 9. In or opposite the zero passage, the dynamo includes a permanent magnet 10 on the balance 4 and a stationary dynamo coil 11 which is connected via a rectifier diode 12 to the capacitor 8 which serves additionally as charging capacitor.

Figure 3:
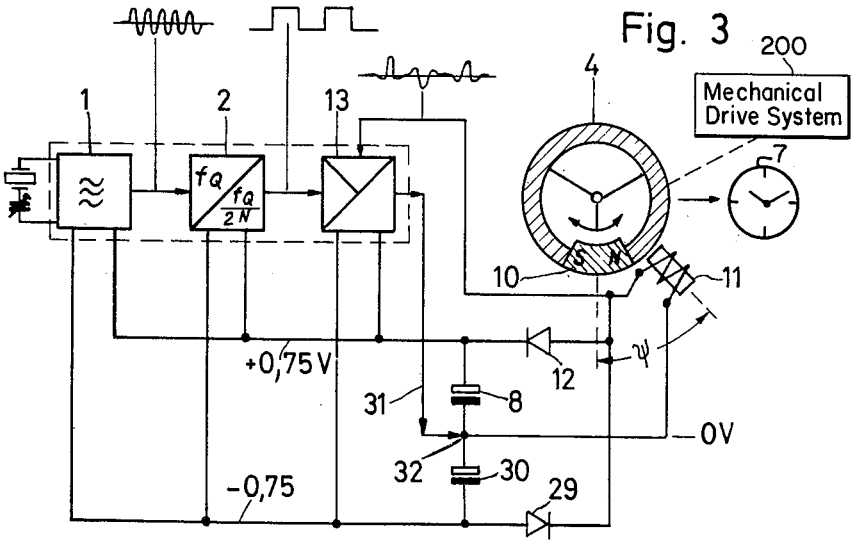
FIG. 3 diagrammatically shows an arrangement for indirect synchronization with a combined dynamo coil and transducer coil.

In the embodiment shown in FIG. 3, the transducer coil 14 of the "regulating dynamo" and the dynamo coil 11 shown in FIG. 2 are united to form a combined dynamo and transducer coil 11. It is offset in relation to the zero passage of the balance 4 and is simply associated with a permanent magnet 10 in the zero passage of the balance 4.

Two series connections, each consisting of a charging capacitor 8 and 30 and of a diode 12 and 29 are connected in parallel with the combined dynamo and transducer coil 11. The diodes 12 and 29 have opposite polarities. The connection point 32 of the charging capacitors 8 and 30 is connected by a line 31 to the output of the phase discriminator 13 effecting phase-dependent loading. The end of the coil 11 which is connected to one pole of the diode 12 also leads to the phase discriminator 13 in order to supply to the latter the alternating voltage signal, produced by the movement, for the purpose of performing a phase and frequency comparison with the timing pulses According to FIG. 3, the operating direct voltage is taken from the two charging capacitors 8 and 30 which are connected serially with respect to voltage. The loading current taken from the "regulating dynamo" by the phase discriminator 13 flows only through the diode 12 so that, as in the embodiment shown in FIG. 1 and 2, asymmetrical dynamo loading is effected.

Figure 4A:
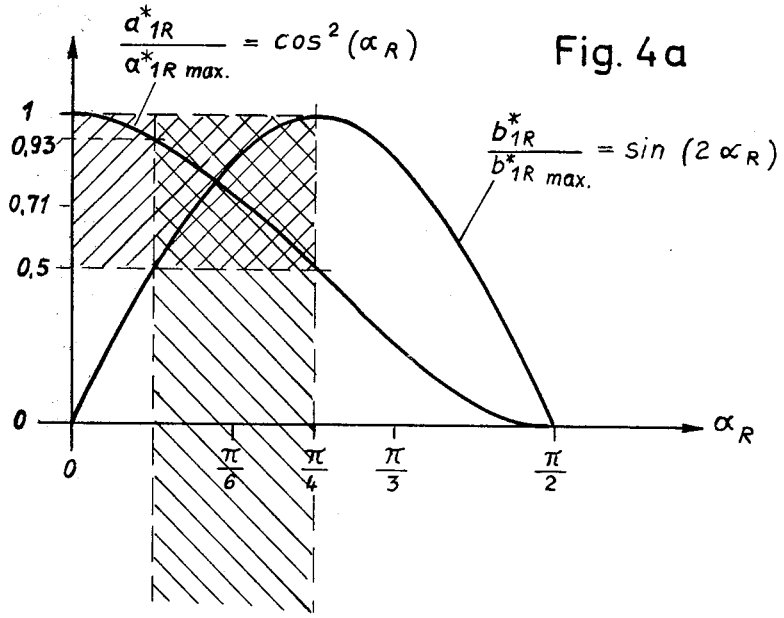
FIGS. 4*a* and 4*b* are charts with curves enabling an optimum range to be read.
Figure 4B:
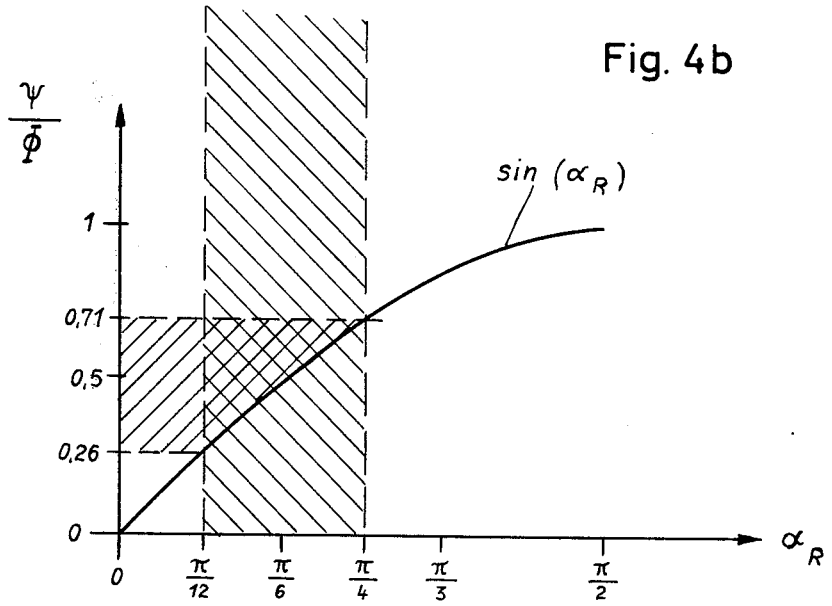

In FIGS. 4*a*, and 4*b*, various functions are shown plotted against phase displacement in time and, for the case shown in FIG. 3, enable the optimum displacement angle in accordance with equation (7) to be read. In FIG. 4*a* are shown the damping, frequency detuning components which are normalized to the maximum values, and which should likewise not fall below a normalized value. This produces limit values for the optimum phase displacement in time from which, by means of equation (2), the corresponding limit values for the optimum displacement angle for the embodiment shown in FIG. 3 are obtained.

This optimum range for the displacement angles can, on the other hand, be read in accordance with FIG. 4*b* from a curve derived from the aforesaid equation and normalized, this curve being plotted on the same scale as in FIG. 4*a*. The limits for the optimum angle of displacement in accordance with equation (7) are also obtained therefrom.

FIG. 5 shows a circuit arrangement for the indirect synchronization of a so-called "escapement" as a separate component of a regulating member provided with a balance. There is a vibration amplitude $\Phi$ of about 180° and the acceleration coil is situated diametrally in relation to the zero passage, that is to say at $\psi = \pi$, so that, in every half-oscillation of the magnet mechanically connected to the balance, a voltage pulse is induced in the acceleration coil.

A quartz timing pulse $u_Q$ passes via a resistor 33 to the base of a transistor 34 opened thereby. A transistor 35 is connected in series with the transistor 34 constituting an AND gate circuit. By a negative pulse induced in it, the acceleration coil 36 opens via a resistor 37 a transistor 38, which at its collector resistor 39 leading to the +1.5 V positive voltage supply, produces a negative voltage pulse which is fed through a resistor 40 to the base of the transistor 35.

If at determined intervals of time, this voltage pulse and the quartz timing pulse arrive simultaneously at the transistors 35 and 34 respectively, both transistors become conductive and by way of a resistor 41 charge a storage capacitor 42. As soon as the voltage of the latter has exceeded the opening threshold of about 0.6 V of a transistor 43, the latter is opened via a resistor 44, which then in turn in the positive half-oscillation of the voltage induced in the acceleration coil 36 loads the latter electrically to a greater or lesser extent and thus either accelerates or retards the running of the balance, depending on the polarity of the coil.

By way of a high-resistance resistor 45, the storage capacitor 42 is gradually discharged when the mean amount of charge supplied by the AND gate 34,35 as the result of the phase comparison becomes smaller. During the positive half-oscillation, a mean loading of the acceleration coil 36 can be simulated for balancing purposes by means of a switch 46 in the position 46*a*, by way of a diode 47 and a resistor 48, so that the timepiece can be adjusted to the required frequency without synchronization.

As an addition to the circuit shown in FIG. 5, the negative half-oscillation of the voltage induced in the acceleration coil can also be loaded by an additional transistor when the regulating voltage in the capacitor 42 falls below 0.6 V and thus the transistor 43, responsible for the loading of the positive half-oscillation, remains blocked. A circuit arrangement of this kind can accelerate and retard the running, and the synchronization range is twice as great as in the case of FIG. 5. However, while the acceleration coil receiving variable loading only in the positive half-oscillation in the case of FIG. 5 is available for producing the phase comparison pulse in the negative half-oscillation, the comparison pulse must here be produced by an additional control coil, which may for example be disposed in the zero passage and act as dynamo coil.

FIG. 6 indicates a particularly simple circuit arrangement for indirect synchronization. In this case, however, a prerequisite is an adequately high induction voltage (for example at lease 3 V) in the "acceleration coil" 36 since, in addition, the flow voltage of two diodes in each case in each case in a Graetz rectifier circuit 58,59,60,61 must be overcome. The phase comparison is effected by a series-AND gate, which consists of the transistor 34 periodically opened by the quartz timing pulse via the resistor 33, and of the Graetz rectifier circuit. A loading current dependent on the relative phase position can flow only if, at the same time, the transistor 34 is opened and a pulse voltage of the coil 36 is higher than the flow voltage of two diodes of the Graetz circuit plus the saturation voltage of the transistor 34. In order to enable the flow voltage per diode to be kept low, it is preferable to use germanium diodes.

Depending on the polarity of the induction voltage the timepiece is accelerated or retarded, whereby a symmetrical lock-in range of the synchronization is insured. The oscillation amplitude can be stabilized by a transistor 62, the opening threshold of which can be adjusted by means of a voltage divider 63,64, since uniform loading with both polarities of the pulse voltage is possible irrespective of the relative phase.

FIG. 7 shows substantially the same synchronization circuit as FIG. 6. The Graetz circuit is, however, used with the aid of a buffer diode 65 and a storage capacitor 66 to produce the feed voltage (for example 1.5 V) for the quartz electronic system, so that the coil 36 together with the oscillating permanent magnet acts at the same time as dynamo as in the case of FIG. 3, and the battery is not required. In order to avoid excessive loading of the timepiece mechanism, high efficiency of this "dynamo" is necessary. The permanent magnet should have an extremely high energy product $(B.H.)_{max}$ and should, for example, consist of a samarium-cobalt alloy.

Figure 8:
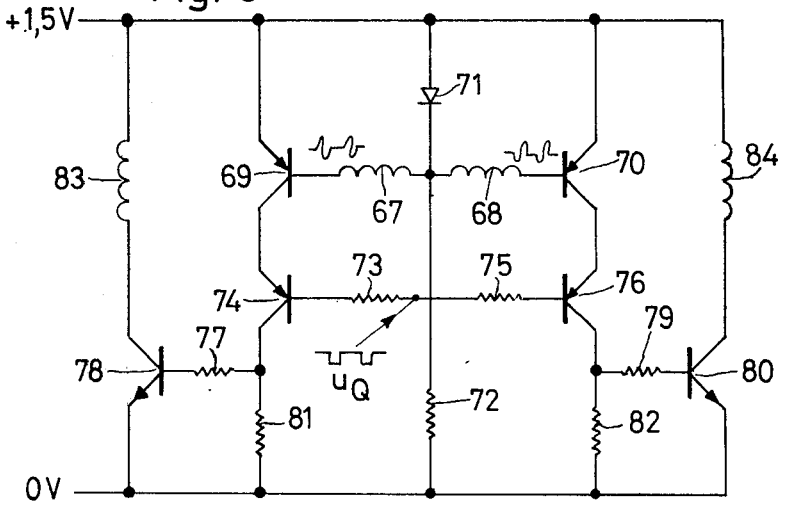
FIG. 8 is a schematic diagram of a two-point synchronization circuit arrangement with electronic phase comparison.

FIG. 8 shows a symmetrical indirect synchronization circuit arrangement which as the result of two separate AND gates, of which only one can be brought into circuit at a time, is capable of extremely versatile use and, in particular is suitable for a novel "two-point synchronization" with phase comparison, which will now be described. The frequency is in this case switched over between two values, one of which must be above and the other below the quartz timing frequency.

Through the phase comparison (indirect synchronization), the retention time in each of the two states is automatically controlled in dependence on the running error of the timepiece in such a manner that the mean frequency and consequently the running of the clock in the synchronized condition agree accurately with the quartz timing frequency.

The induction voltage of a control coil 67,68 tapped in the center is fed in phase opposition to the bases of the transistors 69 and 70, a diode 71 in conjunction with a resistor 72 serving to produce a common bias voltage. The quartz timing pulse ($u_Q$) passes, on the one hand, via a resistor 73 to the base of a transistor 74 and, on the other hand, via a resistor 75 to the base of a transissor 76. The first AND gate, consisting of the transistors 69,74 operates a transistor 78 with the aid of a resistor 77. The second AND gate consisting of the transistors 70,76 operates a transistor 80 with the aid of a resistor 79. Resistors 81,82 connected in series with the AND gates insure that, when the AND gate is blocked, the appertaining output transistor 78,80 are always reliably blocked even if there should be any residual currents.

If the timepiece is running slow, the "on" times of the quartz timing pulse and induction voltage are displaced (within a single quartz timing cycle) until, for example, the first AND gate becomes conductive as the result of a negative pulse at 67 and switches on the output transistor 78. By means of a work coil 83, the output transistor 78 accelerates the running of the timepiece by, for example, coupling an additional spring or by bringing closer a permanent magnet of suitable polarity of by pulse-like acceleration of the oscillating permanent magnet. Similarly, when a timepiece is running fast, the output transistor 80 is switched on by means of the second AND gate, which becomes conductive in this case and, by means of a work coil 84, the output transistor 80 retards the running of the timepiece.

Through the selected polarity of the control pulses in the control coil 67, 68, the maximum "off" time and consequently a saving of current are achieved in two-point operation (acceleration-retardation).

Another advantage of this two-point synchronization with phase comparison, comprises the wide synchronization range and the minimal influence on the oscillation amplitude. The current pulses flowing through the work coils 83,84 for switchover purposes can also be used for remagnetization of a permanent magnet (for example, a stationary permanent magnet) which accelerates or retards in accordance with its own instantaneous polarity the permanent magnet oscillating past it. The remagnetization should take place while the two magnets are a fairly great distance apart.

Figure 9:
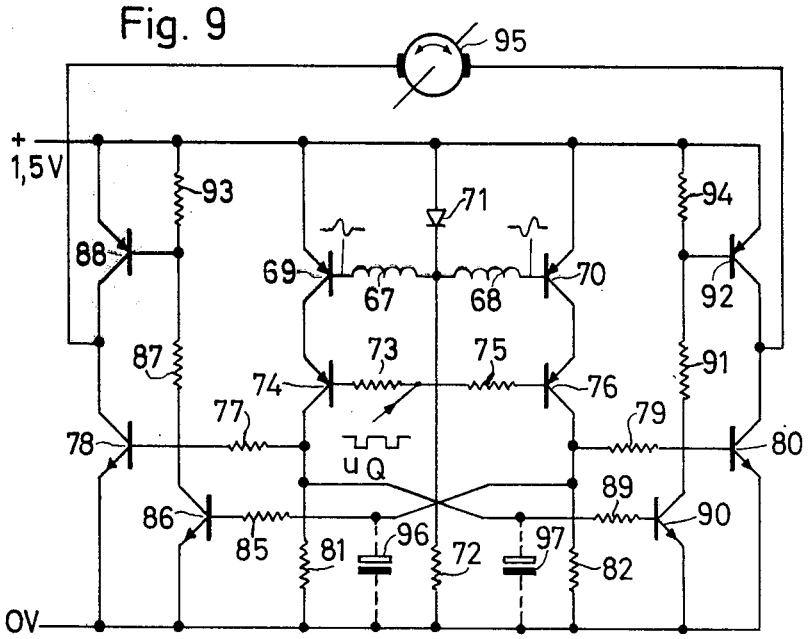
FIG. 9 is a schematic diagram of a synchronization circuit arrangement which is slightly modified on the output side in comparison with FIG. 8.

The circuit arrangement shown in FIG. 9 has the same advantages as that in FIG. 8, that is to say clear and rapid automatic detection of running error, with a very wide synchronization range.

In addition, complementary push-pull output transistors 88 and 92 respectively, which are operated with the aid of reversing stages (85,86,87,93; 89,90,91,94) here permit the driving of the servo motor 95 (or polarized operating magnet), whose direction of rotation clearly depends on the running error. By means of storage capacitors 96,97 the "on" time of the servo motor 95, and consequently its torque averaged in respect of time can be retarded by a number of orders of magnitude. With a synchronization arrangement of this kind, it is possible for particularly large timepieces, such as for example tower clocks, to be reliably synchronized with quartz accuracy.

The indirect synchronization, achieved through electronic phase comparison, of a timepiece, which otherwise works entirely mechanically, by means of quartz-controlled timing pulses permits great accuracy of running and a substantially wider synchronization range in comparison with direct synchronization. The synchronization circuit can be supplied either by means of a dynamo fed by the kinetic energy of the oscillating system. In addition, the transducer coil of a "regulating dynamo" can be combined with the dynamo coil, so that the expense incurred for coils and permanent magnets is kept low.

Although the invention has been explained with reference to a control system intended for timepieces, the control system of the invention is obviously also suitable for mechanical oscillating systems of any kind. Furthermore, the rotational speed of motor or similar rotating systems can be controlled in accordance with the invention.

What is claimed is:

1. A timing apparatus comprising an oscillating system driven by a mechanical energy storage means, a quartz timing oscillator, a frequency divider coupled to said oscillator for forming timing pulses, a synchronization means acted on by said pulses and controlling said system and deriving movement pulses from said system, a phase comparison stage connected to the divider and to the synchronization means, said synchronization means being subjected to a synchronizing action corresponding to the relative phase position between the timing pulses and the movement pulses.

2. An apparatus according to claim 1, wherein said means includes a transducer coil connected to the phase comparison stage, and a permanent magnet coupled to the oscillating system.

3. An apparatus according to claim 2, wherein said system includes a balance and a permanent magnet disposed on the balance within a range of influence on the transducer coil, said coil pointing approximately radially to the center of the balance and a coil core provided in said coil.

4. An apparatus according to claim 2, comprising a voltage supply and a capacitor coupled to the supply and blocking the same against low frequency timing pulses, said supply being coupled to the oscillator, divider and phase comparison stage.

5. An apparatus according to claim 4, wherein the voltage supply is a battery.

6. An apparatus according to claim 4, wherein the voltage supply comprises a dynamo coupled to and by which an operating voltage is produced from kinetic energy of the oscillating system.

7. An apparatus according to claim 6, wherein the dynamo includes a permanent magnet disposed on the oscillating system, and a fixed dynamo coil including a coil core within the range of influence of the latter said magnet, said dynamo further including a rectifier coupled to the latter said coil.

8. An apparatus according to claim 2, wherein a regulating signal is generated by the phase comparison stage and is applied to the transducer coil.

9. An apparatus according to claim 8, wherein the oscillating system is characterized by a zero passage and the transducer coil has a displacement angle relative to said zero passage which for the purpose of achieving the greatest possible frequency control amounts in the optimum case to $$\psi\, opt = 0.71 \cdot \Phi$$

in which $\Phi$ is the amplitude of oscillation of the oscillating system.

10. An apparatus according to claim 9 wherein said means includes means which applies to the oscillating system, a regulating moment ($M_R$) having a fundamental oscillation component $c_{1R}$ whose sine portion is $$b_{1R} \geqq -2 \cdot D \cdot \Phi \cdot \frac{(f_o - f_o^*)}{f_o}$$

wherein D is the direction moment, $\Phi$ the amplitude, and the quotient the relative frequency variation of the oscillating system as the result of the influence of the synchronization.

11. An apparatus according to claim 2, wherein for the purpose of forming and transmitting a movement signal derived from the oscillating system, the transducer coil is connected to a second input of the phase comparison stage.

12. An apparatus according to claim 2, wherein the phase comparison stage includes an AND gate controlled by the timing pulses and by the movement pulses.

13. An apparatus according to claim 12, comprising a storage capacitor connected to said AND gate, a high-resistance shunt in parallel with said capacitor, and a current loading element in parallel with said capacitor and including a control input, said capacitor developing a voltage which is fed to the control input of the current loading element which is connected to the transducer coil.

14. An apparatus according to claim 13, wherein the transducer coil is loaded in unipolar half-oscillations, while the phase comparison or movement pulse is produced in the opposite half-oscillations.

15. An apparatus according to claim 13 comprising a further control coil operatively associated with said oscillation system, the transducer coil being loaded in positive and negative half-oscillations, the phase comparison or movement pulse being produced by said further control coil.

16. An apparatus according to claim 12, wherein the AND gate includes two serially connected transistors connected to the frequency divider for receiving the timing pulses.

17. An apparatus according to claim 12, wherein the AND gate includes a transistor and a Graetz rectifier including germanium diodes connected in series to the transducer coil.

18. An apparatus according to claim 17, comprising a further transistor which has an adjustable switching threshold for adjusting oscillation amplitude and which is connected in parallel to the first said transistor and Graetz rectifier.

19. An apparatus according to claim 17, comprising a feed voltage source means derived from the Graetz rectifier and adapted for acting as a dynamo.

20. An apparatus according to claim 2, comprising a symmetrical indirect two-point synchronization arrangement with electronic phase comparison, in which switching-over is effected between two frequency points which lie above and below the quartz timing frequency.

21. An apparatus according to claim 20, comprising a transducer including a center tap and two phase comparison AND gates connected to the transducer and to the divider, the latter said gates acting in dependence on the phase comparison on one of two work coils adapted for accelerating or braking the oscillation system.

22. An apparatus according to claim 21, wherein the AND gates include transistors, said apparatus further including a servo motor connected to push-pull output transistors operated by way of reversing stages.

23. An apparatus according to claim 6, characterized in that the said means and the dynamo for producing an operating voltage are combined and a single permanent magnet in the oscillating system is used for both.

24. An apparatus according to claim 23, comprising two series connections, each consisting of a charging capacitor and a diode, are connected in parallel, the two diodes having opposite polarities, an operating direct current voltage being taken off by doubling from both charging capacitors, the junction of the charging capacitors leading to the output of the phase comparison stage, and the dynamo and transducer coil being displaced by a displacement angle in relation to the zero passage of the oscillating system.

25. An apparatus according to claim 24, wherein the azimuthal displacement angle in the optimum case is selected within the limits $$0.26\Phi < \phi opt < 0.71\Phi$$

wherein $\Phi$ is the amplitude of oscillation of the oscillating system.

26. A method of synchronizing an oscillating system driven by a mechanical energy storage means and having a regulating member which is set and maintained in oscillation by a pulselike driving moment and which is synchronized by timing pulses derived by division of the oscillations of a quartz oscillator, the synchronizing being achieved through an electromagnetic coupling; said method comprising deriving an alternating voltage signal from movement of said oscillating system, comparing phase and frequency between said timing pulses and said alternating voltage signal, deriving a regulating signal from the comparison, utilizing the regulating signal to produce a torque $M_R$, and applying said torque as a regulating action to the oscillating system.

27. A method as claimed in claim 26 wherein the synchronizing and regulating are effected on the oscillating system via a common path.

28. A method as claimed in claim 26 wherein the oscillating system includes a balance and said alternating voltage signal is derived from said balance.

29. A method according to claim 26, wherein the synchronization is effected with an azimuthal displacement angle $\Phi$ of the torque $M_R$ in relation to the zero passage of the oscillating system, while the optimum displacement angle for achieving the greatest possible frequency control amounts to $$\Phi \text{ opt} = 0.71 \cdot \psi$$

in which $\Phi$ is the amplitude of oscillation of the oscillating system.

30. A method according to claim 29 wherein a sine portion $b_{1R}$ of the fundamental oscillation component $c_{1R}$ of the torque $M_R$ is selected as $$b_{1R} \geqq -2 \cdot D \cdot \Phi \cdot \frac{f_o - f_o^*}{f_o}$$

where D is the direction moment, $\Phi$ the amplitude, and the quotient the relative frequency variation of the oscillating system as the result of the influence of the synchronization.

* * * * *